United States Patent [19]

Martinez

[11] 4,358,646

[45] Nov. 9, 1982

[54] SLIDE SELECTOR SWITCH

[75] Inventor: Arthur T. Martinez, Long Beach, Calif.

[73] Assignee: T.A.D. Avanti, Inc., Compton, Calif.

[21] Appl. No.: 223,350

[22] Filed: Jan. 8, 1981

[51] Int. Cl.[3] ..... H01H 3/00; H01H 15/00

[52] U.S. Cl. ..... 200/5 R; 200/1 B; 200/5 E; 200/16 R; 200/18; 200/50 C; 200/330

[58] Field of Search ..... 200/1 R, 1 K, 1 B, 5 R, 200/5 E, 16 R, 16 C, 16 D, 17 R, 18, 153 LA, 307, 329, 330, 340, 50 C

[56] References Cited

U.S. PATENT DOCUMENTS

| | | | |
|---|---|---|---|
| 2,789,167 | 4/1957 | Erbstosser | 200/18 |
| 3,369,100 | 2/1968 | Kussy et al. | 200/330 |
| 3,472,977 | 10/1969 | Ziegler, Jr. | 200/153 LA X |
| 4,012,606 | 3/1977 | Hutt | 200/18 |
| 4,052,582 | 10/1977 | Mullen et al. | 200/330 |
| 4,107,499 | 8/1978 | Weidler | 200/18 X |
| 4,115,670 | 9/1978 | Chandler | 200/330 X |

OTHER PUBLICATIONS

IBM Technical Disclosure Bulletin; J. W. Rudolph, "Sliding Selector Switch", Nov. 1979, vol. 22, No. 6, pp. 2324, 2325.

*Primary Examiner*—J. R. Scott

*Attorney, Agent, or Firm*—Keith D. Beecher

[57] ABSTRACT

A mechanical slide selector switch assembly, or the like, is provided which includes a plurality of multi-contact switches mounted in side-by-side relationship, and which also includes a slidable actuator mounted in transverse relationship with the switches for successively actuating the switches as the actuator is moved back and forth along a rectilinear path.

13 Claims, 10 Drawing Figures

FIG.3
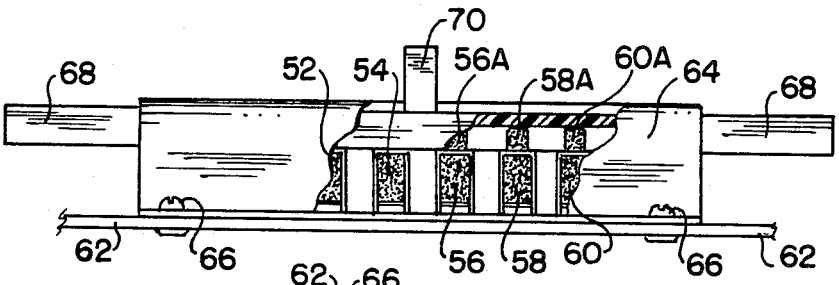
FIG.4
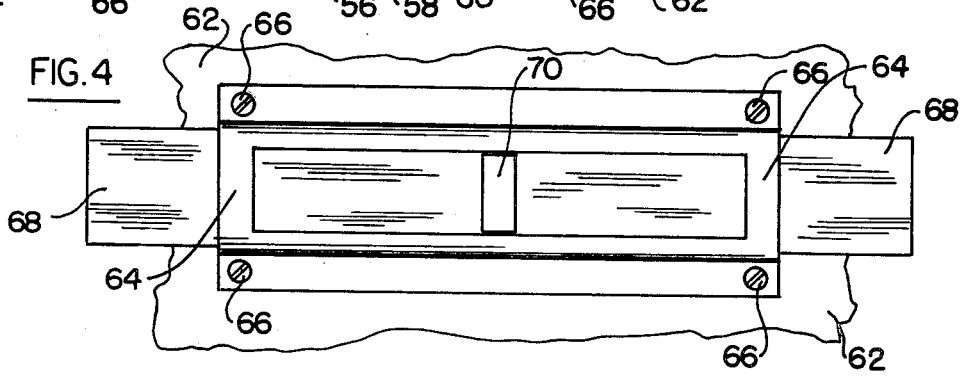
FIG.5
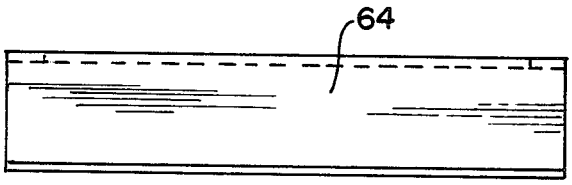
FIG.6
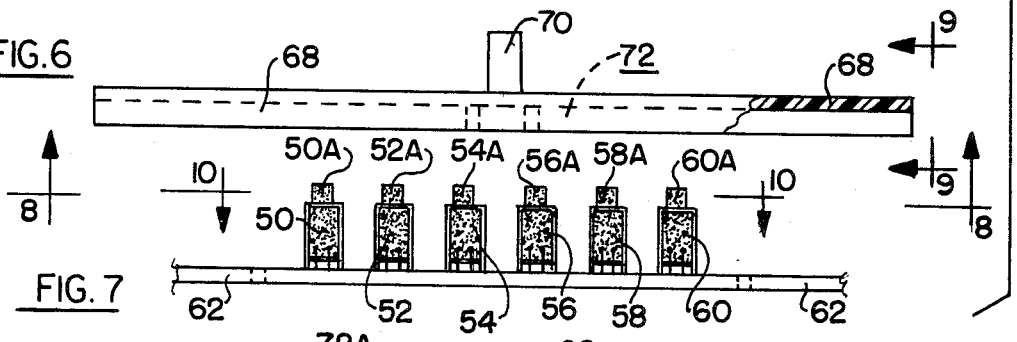
FIG.7
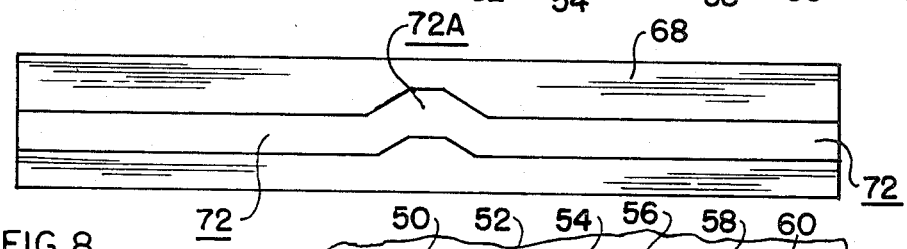
FIG.8
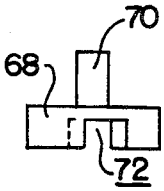
FIG.9
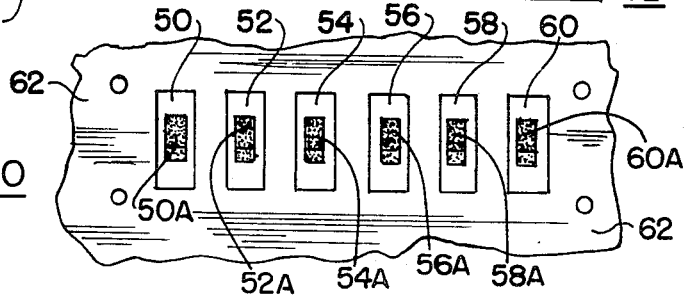
FIG.10

SLIDE SELECTOR SWITCH

BACKGROUND

The slide switch assembly of the invention finds particular utility in complex electrical and electronic systems, such as telephone answering systems, in which a large number of switching contacts are to be operated as the switch is moved from one position to another, and in which it is imperative that only one set of contacts be operated at any one time. The selector switch assembly of the invention is ideal for such uses since it is economical in its construction, since it requires a minimum of space, and since it is inherently mechanically interlocked because the actuator is capable of actuating only one of the switches at any one time as the slider is moved from one position to the next.

Although the embodiments to be described incorporate switches to be successively actuated by the actuator, it will become apparent as the description proceeds, that the switches may be replaced by other electrical elements, such as potentiometers and the like.

BRIEF DESCRIPTION OF THE DRAWINGS

FIG. 3 is a side elevation, partly in section, of a selector switch assembly representing a second embodiment;

FIG. 4 is a top plan view of the embodiment of FIG. 3;

FIG. 5 is a side elevation of the housing of the assembly of FIGS. 3 and 4;

FIG. 6 is a side elevation of the actuator of the assembly of FIGS. 3 and 4;

FIG. 7 is a side elevation of a series of switches included in the assembly of FIGS. 3 and 4;

FIG. 8 is a bottom view of the actuator taken along the line 8—8 of FIG. 6;

FIG. 9 is an end view of the actuator taken along the line 9—9 of FIG. 6; and

FIG. 10 is a top view of the switches, taken along the line 10—10 of FIG. 7.

DETAILED DESCRIPTION OF THE ILLUSTRATED EMBODIMENT

Figure 1:
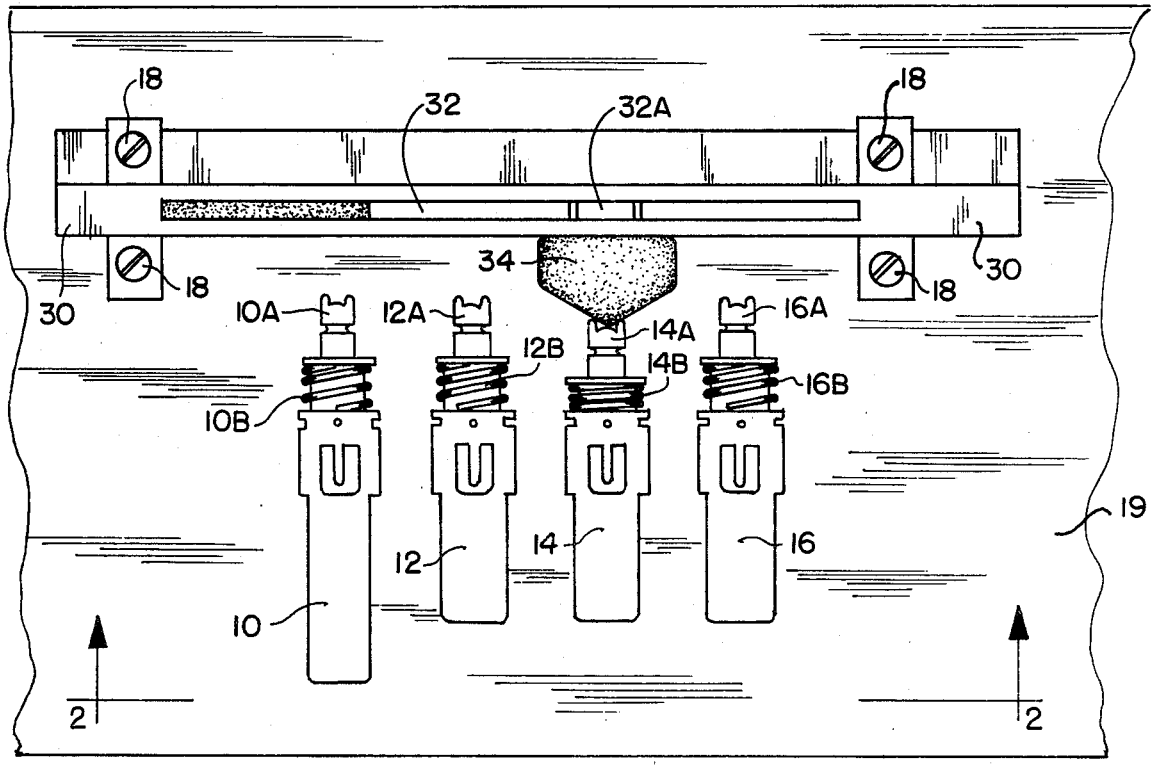
FIG. 1 is a top plan view of a selector switch assembly incorporating the concepts of the invention in one of its embodiments.

The selector switch assembly of FIG. 1 includes a plurality of pushbutton switches designated 10, 12, 14, and 16, which are mounted in side-by-side relationship on a base 19. Each of the pushbutton switches includes a movable member designated 10A, 12A, 14A and 16A, and each movable member is reciprocally movable along a rectilinear path between a first position and a second position to actuate the corresponding switch. Each of the movable members is spring-biased to the first position by springs 10B, 12B, 14B and 16B.

A slide bracket 30 is mounted on base 19 in transverse relationship with the various pushbutton switches 10, 12, 14 and 16 and is held in place by screws 18. A slide 32 is mounted in the slide bracket 30 for reciprocal movement along a rectilinear path transversing the paths of the movable members of the various pushbutton switches. An actuator 34 is mounted on the slide 32, and the actuator successively engages the movable members of the pushbutton switches, as the slide is moved from one position to the next. As the actuator engages each movable member, it causes the movable member to move against its spring-bias from its first position to its second position, thereby actuating the corresponding pushbutton switch.

The pushbutton switches may be the multi-contact type, such as described, for example, in U.S. Pat. No. 4,100,384. The slide bracket 30 may conveniently be formed as a metal extrusion, and the slide 32 and actuator 34 may be formed of appropriate plastic. The slide 32 is provided with a handle 32A to permit manual operation of the slide for successive actuation of the switches.

Figure 2:
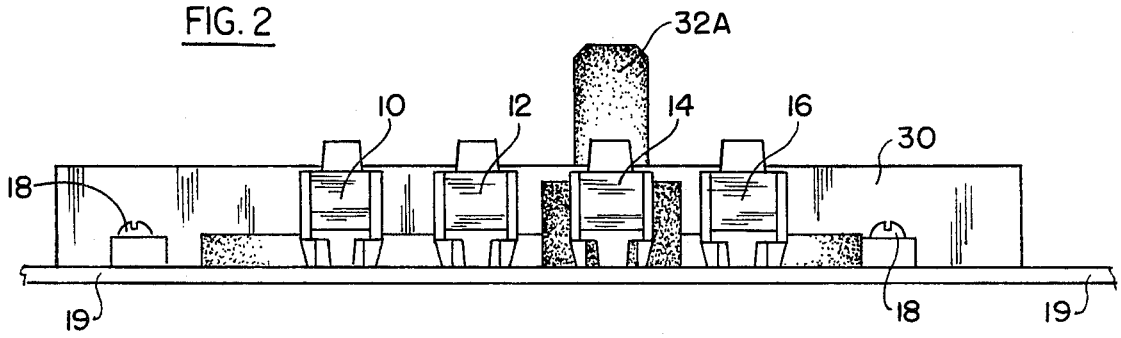
FIG. 2 is a view taken along the line 2—2 of FIG. 1.

In the embodiment of FIGS. 3–10, the pushbutton switches of the embodiment of FIGS. 1 and 2 are replaced by multi-contact slide switches 50, 52, 54, 56, 58 and 60; the switches being mounted on a base 62. The switches have respective switching elements 50A, 52A, 54A, 56A, 58A and 60A, each of which is movable laterally between a first and a second position to operate the individual switches.

An elongated, open-ended housing 64 is mounted on base 62 by screws 66. A slide switch actuator 68 is mounted in housing 64 and is reciprocally movable in the housing by means of a handle 70.

A channel 72 is formed on the underside of actuator 68, and the switching elements 50A, 52A, 54A, 56A and 60A all extend into the channel. Channel 72 has a laterally displaced portion 72A, and when the actuator is moved back and forth in housing 64, the switch elements 50A, 52A, 54A, 56A and 60A are successively moved between first and second positions by the displaced channel portion 72A.

It will be appreciated that the invention provides a simple and economical slide selector switch assembly which is inherently interlocked and which operates successively to actuate a plurality of switches, each of which may be of the multi-contact type.

The assembly is extremely flexible, since more or less switches may be incorporated into the assembly, depending upon the particular application.

While particular embodiments of the invention have been shown and described, modifications may be made. It is intended in the claims to cover all modifications which come within the spirit and scope of the invention.

What is claimed is:

1. A mechanical selector assembly including: a plurality of discrete electrical elements mounted adjacent to one another, each of said elements including a member reciprocally movable between a first and a second position; an elongated slide member mounted for reciprocal movement along a rectilinear path with respect to the electrical elements between predetermined limits; and an actuator on said slide member in position successively to engage the respective movable members of said electrical elements as said slide member is moved along said rectilinear path between said predetermined limits so as to cause said movable members of said discrete electrical elements to move successively in directions transversely of said path between the first and second positions as the slide member is moved along said path.

2. The assembly defined in claim 1, and which includes a housing mounted in transverse relationship with respect to the electrical elements, said elongated slide member being mounted in the housing for reciprocal rectilinear movement therein.

3. The assembly defined in claim 2, in which said electrical elements are pushbutton electric switches, and each of said switches includes resilient means biasing the corresponding movable member toward said first position.

4. The assembly defined in claim 3, in which the respective movable members of said electrical switches are reciprocally movable along rectilinear paths spaced and parallel to one another, and said slide member is reciprocally movable in said housing along a rectilinear path perpendicular to the paths of the movable members of the switches.

5. The assembly defined in claim 3, in which the pushbutton switches are of the multi-contact type.

6. The assembly defined in claim 1, in which the electrical elements are switches.

7. A mechanical selector assembly including: a plurality of electrical elements mounted adjacent to one another, each of said elements including a member reciprocally movable between a first and a second position; a slide member mounted for movement along a particular path with respect to the electrical elements; and an actuator on said slide member in position to cause the respective movable members of said electrical elements to move successively between the first and second positions as the slide member is moved along said path, in which said slide member has a longitudinally-extending channel therein to constitute said actuator, and the movable member of each of the electrical elements extends into the channel, said channel having an offset portion for causing the movable members to move between the first and second positions as the slide member is moved along said path.

8. The assembly defined in claim 7, in which said electrical elements are switches.

9. The assembly defined in claim 8, in which the switches are of the multi-contact type.

10. The assembly defined in claim 8, in which the respective movable members of said electrical switches are reciprocally movable along rectilinear paths spaced and parallel to one another, and said slide member is reciprocally movable in said housing along a rectilinear path transversing the path of the movable members of the switches.

11. A mechanical selector assembly including: a plurality of discrete electrical elements mounted adjacent to one another, each of said elements including a member reciprocally movable between a first and a second position; an elongated slide member mounted for reciprocal movement between predetermined limits along a rectilinear path with respect to the electrical elements; and an actuator on said slide member in position successively to engage the respective movable members of said electrical elements as said slide member is moved along said path between said predetermined limits so as to cause said movable members to move successively in directions transverse to said path between the first and second positions as the slide member is moved along said path, said slide member having a longitudinally-extending channel therein to constitute said actuator, and the movable member of each of the electrical elements extending into the channel, said channel having an offset portion for causing the movable members of said electrical elements to move between the first and second positions as the slide member is moved along said path between said predetermined limits.

12. The assembly defined in claim 11, and which includes a housing mounted in transverse relationship with respect to the electrical elements, said slide member being mounted in said housing for reciprocal rectilinear movement therein.

13. The assembly defined in claim 12, in which said electrical elements are switches, and in which the respective movable members of said electrical switches are reciprocally movable along rectilinear paths spaced and parallel to one another, and said slide member is reciprocally movable in said housing along a rectilinear path transversing the path of the movable members of the switches.

* * * * *